United States Patent [19]

Aanstad

[11] 3,939,660

[45] Feb. 24, 1976

[54] ACCELERATION CONTROL ARRANGEMENT FOR TURBINE SYSTEM, ESPECIALLY FOR HTGR POWER PLANT

[75] Inventor: Ola J. Aanstad, Greensburg, Pa.

[73] Assignee: Westinghouse Electric Corporation, Pittsburgh, Pa.

[22] Filed: Oct. 31, 1974

[21] Appl. No.: 519,703

Related U.S. Application Data

[63] Continuation-in-part of Ser. No. 367,991, June 7, 1973, abandoned.

[52] U.S. Cl. ..... 60/661; 60/707

[51] Int. Cl.[2] ..... F01K 9/00

[58] Field of Search ..... 60/660, 661, 663, 707, 60/656, 657

[56] References Cited

UNITED STATES PATENTS

| | | | |
|---|---|---|---|
| 2,540,691 | 2/1951 | Reese et al. | 60/657 X |
| 2,811,837 | 11/1957 | Eggenberger | 60/663 |
| 3,205,664 | 9/1965 | Nettel | 60/656 |
| 3,359,732 | 12/1967 | Schuetzenduebel | 60/656 |
| 3,572,036 | 3/1971 | Beckman | 60/646 |
| 3,623,324 | 11/1971 | Eggenberger | 60/660 X |

FOREIGN PATENTS OR APPLICATIONS

| | | | |
|---|---|---|---|
| 1,401,447 | 5/1969 | Germany | 60/663 |

*Primary Examiner*—Martin P. Schwadron
*Assistant Examiner*—H. Burks, Sr.
*Attorney, Agent, or Firm*—E. F. Possessky

[57] ABSTRACT

In a turbine system with first and second turbine stages, each having a bypass line thereacross, provision is made for utilizing only the valving of the first turbine stages to control the acceleration of the shaft driven by the turbine system from start-up to synchronous speed. At the same time, provision is made for diverting enough of the flow to the second turbine stages to meet the requirements of those stages.

31 Claims, 3 Drawing Figures

ACCELERATION CONTROL ARRANGEMENT FOR TURBINE SYSTEM, ESPECIALLY FOR HTGR POWER PLANT

CROSS REFERENCES TO RELATED APPLICATIONS

This application is a continuation-in-part of Ser. No. 367,991, "Acceleration Control Arrangement for Turbine System", filed on June 7, 1973 by Ola J. Aanstad assigned to the present assignee, and now abandoned.

BACKGROUND OF THE INVENTION

1. Field of the Invention:

This invention relates generally to an arrangement for controlling the acceleration of a turbine system from start-up to synchronous speed, and more specifically, this invention relates to an arrangement for controlling the acceleration of a steam turbine system having bypass lines across the high pressure turbine and across the intermediate and low pressure turbines, such as in a turbine system interfaced with a high temperature gas cooled reactor (HTGR).

2. Description of the Prior Art:

In a conventional steam turbine system where all of the steam flow passes through all the turbine elements in the system (except for the extraction flow), control of acceleration of the turbine-generator rotor upon start-up must be accomplished by adjustment of the throttle valve or the control valve, which regulates flow through the high pressure, intermediate and low pressure turbine elements. The reheat stop and interceptor valves are normally kept wide open. Since all of the steam flow passes through all the turbine stages, the pressure in the reheater is, thus, dictated by the flow through the throttle and control valves. Since the reheat stop and interceptor valves are wide open, the high, intermediate and low pressure turbine torques are all given by the positioning of the throttle valve or the control valve, whichever is being utilized for startup control.

In some turbine systems, bypass lines are provided around the individual turbines for use during start-up of the system. Such a bypass arrangement for starting is generally referred to as a "European" type bypass arrangement. A similar type of bypass arrangement, in which a first bypass line is connected across the high pressure turbine and a second bypass line is connected across the intermediate and low pressure turbines, is utilized when a steam turbine is interfaced with a "once through" steam supply system, such as a high temperature gas cooled reactor (HTGR). In a turbine interfaced with an HTGR system, a drive arrangement for the cooling gas (e.g., helium circulators) is provided by additional steam turbines in the steam flow path of the main turbine system. In order to remove the heat generated in the reactor core, these turbines must be driven at all times, even when the main turbine system is not providing a power output. Accordingly, a minimal amount of steam flow must be provided by an auxiliary boiler system before reactor start-up. The bypass lines across the high pressure turbine and across the intermediate and low pressure turbines provide a steam path for this initial flow. Normally, the minimum reactor flow is 25%, due to steam generator stability problems. This flow will bypass the main turbine, if the main turbine is shut down.

With a steam turbine having a "European" type bypass arrangement, or a steam turbine interfaced with an HTGR, acceleration of the turbine system is achieved by diverting a portion of the flow from the bypass lines to the turbines. The type of control utilized in conventional systems cannot be utilized with this type of system, since the reheater is pressurized (25% of rated flow) before steam turbine start-up, and thus the reheat stop and interceptor valves cannot be fully opened during start-up. Further, to achieve acceleration control by just modulating the throttle and control valves is not feasible, since a certain amount of steam flow is required to the intermediate and low pressure turbines. The steam flow to the intermediate and low pressure turbines is required for exactly opposite reasons. During start-up of the low pressure turbine, the "windmilling" of the turbine blades results in a large heat buildup in these blades, and thus the steam is required for cooling purposes. In the intermediate turbine, on the other hand, it is necessary to heat the metal of the turbine blades above a certain critical temperature prior to loading, and thus the steam through the intermediate pressure turbine provides a warming or heating function. Therefore, the interceptor valve must be utilized to control steam flow to the intermediate and low pressure stages during start-up. As only a small flow is required, this control is difficult for the interceptor valve, as this valve is designed for control of much greater flow rates.

SUMMARY OF THE INVENTION

To improve acceleration control of a steam turbine system having a bypass arrangement, of the "European" type or of the type interfaced with an HTGR, the present invention has been developed. In the arrangement produced according to this invention, acceleration control is achieved by adjustment of only the throttle valve or the control valve to regulate steam flow to the high pressure turbine. At the same time, the requisite steam is supplied to the intermediate and low pressure turbines, without requiring adjustment of the interceptor valve in synchronism with the modulation of the throttle or control valve. This is achieved by utilizing a small start-up bypass valve across the interceptor valve. This start-up bypass valve is not position modulated (i.e., it is simple on-off or open-close valve), which is opened wide upon the initiation of start-up. In view of its smaller size, determination of the flow that is passed to the intermediate and low pressure turbines is much more accurate than if the interceptor valve were utilized to provide this small flow, since the interceptor valve has to be relatively very large in order to handle steam flow many times greater than that required by the intermediate and flow pressure turbines during acceleration. By use of this start-up bypass valve, it is possible to regulate acceleration of the system by modulation of the throttle or control valve only.

In a turbine system constructed according to the present invention, there would be a first turbine stage, such as a high pressure turbine, and a second turbine stage, such as intermediate and low pressure turbines. First flow control valving, such as the throttle and control valves, would be connected in the flow path of the high pressure turbine to control the flow therethrough. Similarly, second flow control valving, such as a reheat stop valve and an interceptor valve, would be connected in the flow path of the intermediate pressure and low pressure turbines to control the flow therethrough. A first bypass line would be connected to shunt steam flow around the first turbine stage and the first flow control valving, and a second by-pass line would be connected to shunt steam flow around the second turbine stage and the second flow control valving. A first actuating means would adjust the first flow control valving, while second actuating means would adjust the second flow control valving. A start-up bypass valve has been connected across the interceptor valve, although this start-up bypass valve might also be connected across both the reheat stop valve and the interceptor valve, or just across the reheat stop valve. A third actuating means is then utilized to control the start-up bypass valve.

With this arrangement, the third actuating means will open the start-up bypass valve upon initiation of start-up of the turbine system, the second actuating means will open the reheat stop valve, and the first actuating means will then control the acceleration of the turbine system by appropriate adjustements of the throttle valve or the control valve. As a result, acceleration of the turbine system may by accurately controlled without the necessity of utilizing the interceptor valve to either aid in adjusting acceleration or to accurately provide the small amount of steam required in the intermediate and low pressure turbines.

The foregoing and other objects, advantages and features of this invention will hereinafter appear, and for purposes of illustration, but not of limitation, an exemplary embodiment of the subject invention is shown in the appended drawing.

DESCRIPTION OF THE PREFERRED EMBODIMENT

Figure 1:
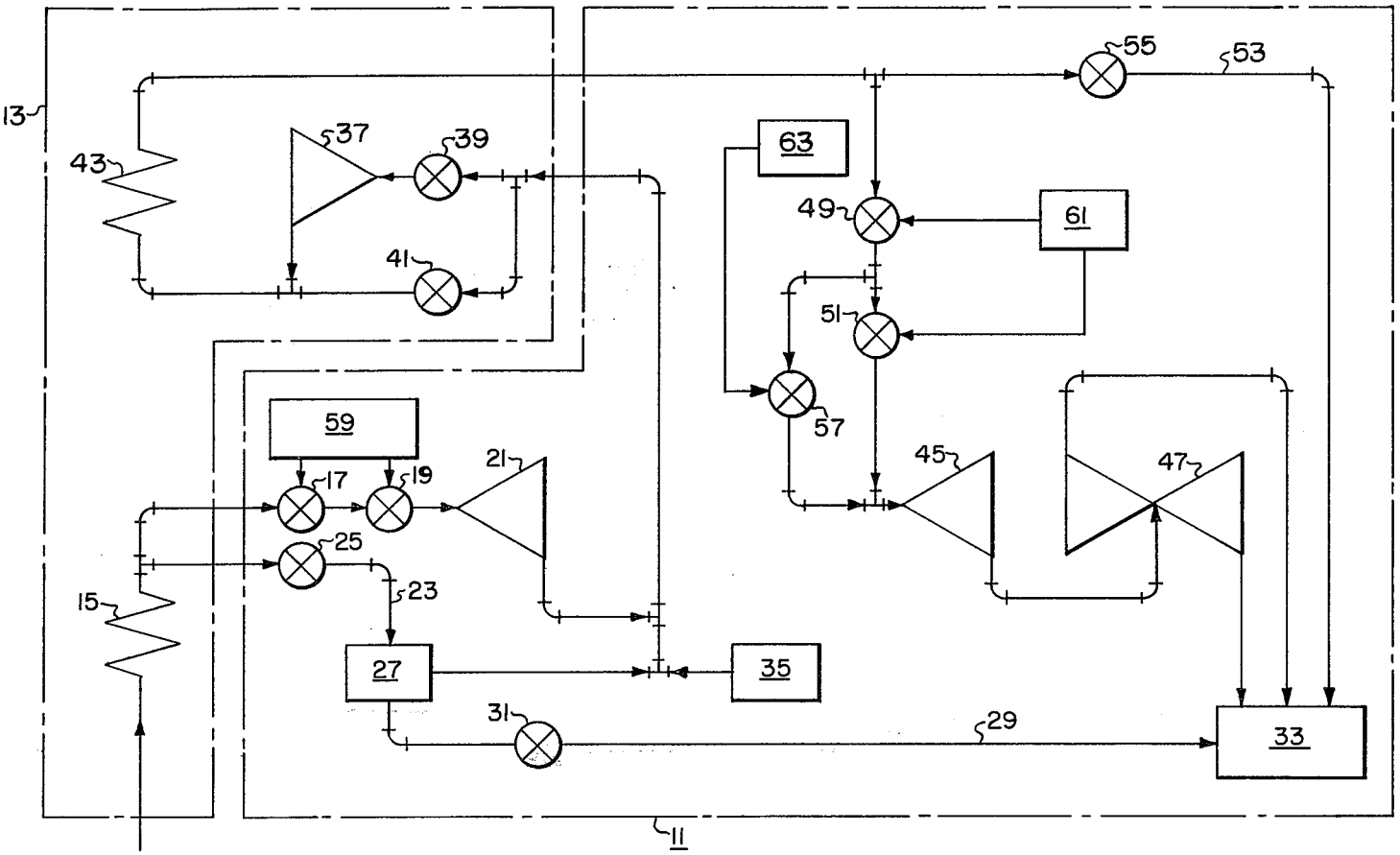
FIG. 1 shows a schematic diagram of a speed control system according to one embodiment of the present invention.

With reference to the drawing, there is shown a schematic illustration of a steam turbine system 11 interfaced with a high-temperature gas cooled reactor (HTGR) 13. In the HTGR 13, water is boiled to produce steam and then super-heated in a steam generator 15. Steam from the steam generator 15 is passed to a throttle valve 17 and a control valve 19. Throttle valve 17 and control valve 19 provide flow control valving for a high pressure turbine 21.

A first bypass line 23, having a first bypass valve 25 therein, is connected to shunt or bypass steam around throttle and control valves 17 and 19 and high pressure turbine 21. A flash tank 27 is also connected in the first bypass line 23 to pass steam to the system and, through a line 29, controlled by a valve 31, to a condenser 33. An auxiliary steam generator 35 provides additional steam during start-up operation.

Steam from the high pressure turbine 21 and/or bypass line 23 is then conveyed to a circulator turbine 37. Turbine 37 drives a cooling gas through the HTGR 13. In this particular case, the cooling gas is helium. A helium circulator speed control valve 39 regulates the steam flow through turbine 37, while a helium circulator bypass valve 41 regulates the pressure drop across turbine 37. From the helium circulator turbine 37 the steam then passes to a reheater 43, prior to being conveyed to the second stage of the turbine system. (It should be noted that the HTGR would normally be equipped with several helium circulator turbines 37 operating in parallel).

From the reheater 43, the steam is conveyed to an intermediate pressure turbine 45 and a low pressure turbine 47 through a reheat stop valve 49 and an interceptor valve 51. Reheat stop valve 49 and interceptor valve 51 provide a flow control valving arrangement for the intermediate and low pressure turbines 45 and 47. From the low pressure turbine 47 steam is then conveyed to the condenser 33.

A second bypass line 53 is connected to shunt or bypass steam around the intermediate and low pressure turbines 45 and 47, together with the reheat stop valve and the interceptor valve 51. A second bypass valve 55 regulates the flow of steam through bypass line 53.

A start-up bypass valve 57 is connected across interceptor valve 51. Start-up bypass valve 57 provides a shunt or bypass path for the steam to reach the intermediate and low pressure turbines 45 and 47 when the interceptor valve 51 is closed. As the amount of steam required in the intermediate and low pressure turbines 45 and 47 during start-up of the system is quite small (approximately 2–4% of the maximum steam from steam generator 15), start-up bypass valve 57 may be considerably smaller than the interceptor valve 51. Also, only one start-up bypass valve 57 is required, while in practice there would normally be a plurality of interceptor valves 51 in parallel (for example, in one specific embodiment four interceptor valves 51 are utilized). Since start-up bypass valve 57 only needs to provide a specified amount of steam during start-up of the system, it may be a simple open-close or on-off valve. Such a simple valve eliminates the problems of obtaining the appropriate adjustment, as would be the case if it were position modulated, while at the same time providing a much more accurate control of the steam flow at these low levels than would be provided by the much larger position modulated interceptor valve 51.

A first actuating apparatus 59 is utilized to adjust throttle valve 17 or control valve 19. Also in practice, there would actually be a plurality of throttle valves 17 and control valves 19. As the throttle valves are operated in parallel to provide full arc steam admission, in this preferred embodiment throttle valve 17 is utilized to regulate flow upon initiation of start-up. Therefore, actuating apparatus 59 initially opens control valve 19 wide open and then adjusts throttle valve 17 until a specified speed has been reached, at which time throttle valve 17 is opened wide and flow regulation is switched to control valve 19.

A second actuating apparatus 61 is so arranged as to adjust the reheat stop valve 49 and the interceptor valve 51. Actuating apparatus 61 may involve different controls for the reheat stop valve 49 and the interceptor valve 51. For instance, reheat stop valve 49 and interceptor valve 51 are conventionally mechanically actuated valves that are not positioned modulated (i.e., they are simple on-off or open-close valves). The location of start-up bypass valve 57 is a direct consequence of the mechanical actuation of reheat stop valve 49 upon latching of the turbine system. (The term "latching" is a well recognized term in the art with historical origins that refers to initiation of start-up in the turbine system). Actually, it would be equally feasible to have start-up bypass valve 57 connected across both reheat stop valve 49 and interceptor valve 51, or to connect start-up bypass valve 57 across reheat stop valve 49 and cause the actuating apparatus 61 to open interceptor valve 51 upon latching.

Adjustment of start-up bypass valve 57 is achieved by a third actuating apparatus 63. Apparatus 63 opens start-up bypass valve 57 upon latching of the turbine system. Bypass valve 57 will then remain open until the system is initially loaded, unless an overspeed condition is detected or the steam turbine is tripped, in which event start-up bypass valve 57 would be closed. Upon initial loading of the system, start-up bypass valve 57 is closed, as loading would result in opening of interceptor valve 51, which would provide the necessary steam to the intermediate and low pressure turbines 45 and 47.

To briefly summarize the operation of the turbine system incorporating the present invention, latching of the system would result in control valve 19 and reheat stop valve 49 being opened wide. At the same time, start-up bypass valve 57 would also be opened wide to bypass interceptor valve 51, which would remain closed. Control of the acceleration of the system would then be achieved by adjustment of throttle valve 17 until a predetermined speed were reached, at which time throttle valve 17 would be opened wide and control valve 19 would be partially closed down and then gradually reopened to control acceleration.

Figure 2:
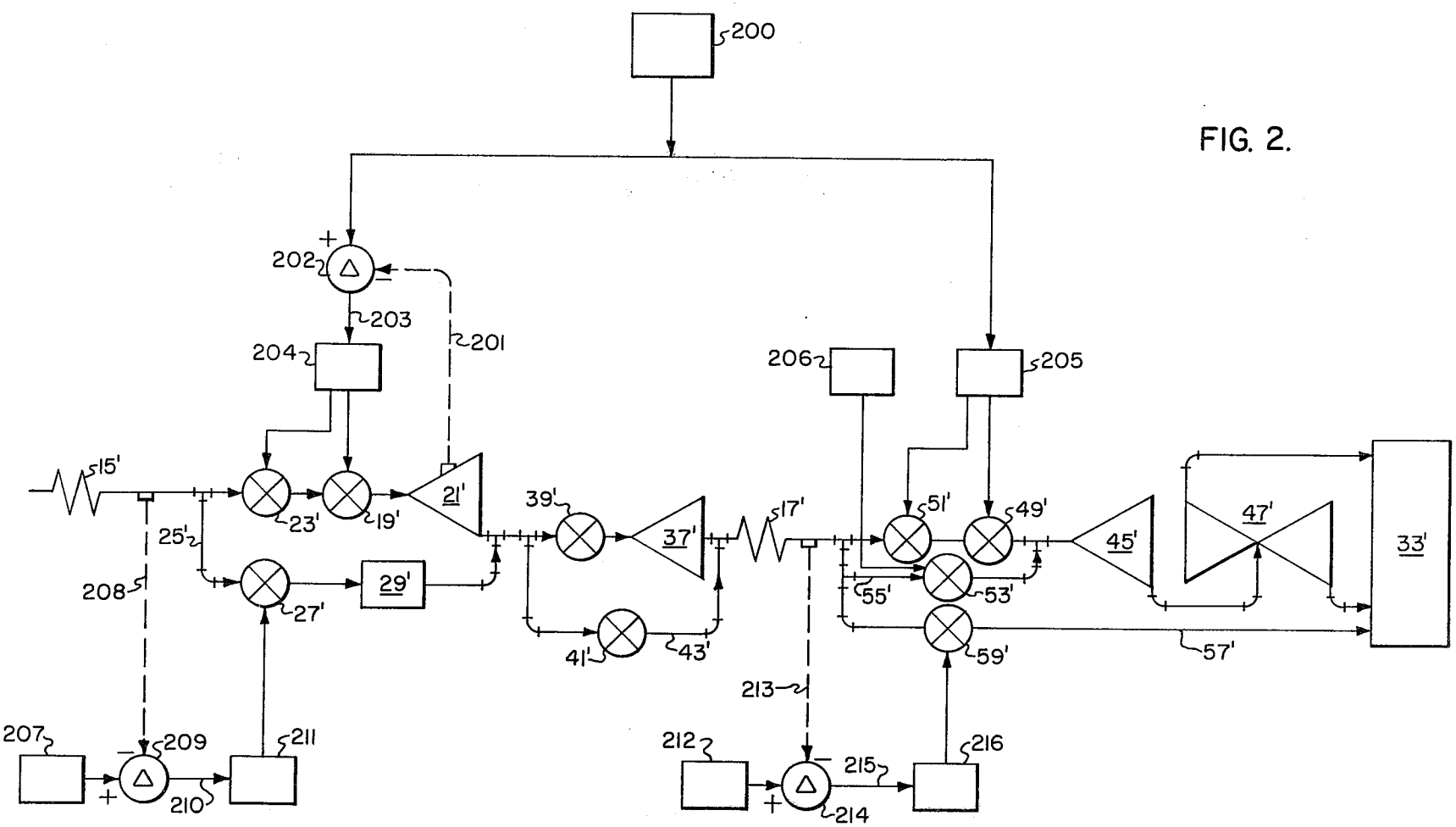
FIG. 2 shows a schematic diagram of a speed control system according to another embodiment of the present invention.

Referring to FIG. 2 there is shown an arrangement for controlling the shaft speed of the turbine system comprising the turbines 21', 45', and 47' in accordance with a desired shaft speed signal that is generated by an input means 200. A speed detecting means is connected to detect the shaft speed of the turbine system and generates an output signal on a line 201 that represents the detected speed. The output signals of the input means 200 and of the speed detecting means 201 are transmitted to a comparison device 202 that generates an output signal on a line 203 representative of the speed error, or difference, between the desired and detected shaft speeds. A regulating means 204 positions the throttle valve 23' or the governor valve 19' in accordance with the signal on the line 203 to vary the steam flow through the high pressure turbine 21' to reduce the speed error to a zero steady state valve. The throttle valve 23' is positioned to control shaft speed when the shaft speed is less than a predetermined value. The control valve 19' is fully open at such times. The control valve 19' is positioned to control shaft speed when the shaft speed exceeds the predetermined speed value. The throttle valve 23' is fully open at such times. To effect acceleration of the turbine system, the desired shaft speed signal from the input means 200 is increased from turning gear speed to synchronous speed at a rate that does not subject the turbine system to harmful thermal stress.

A regulating means 205 is connected to position the reheat stop valve 51' and the intercept valve 49'. During the time interval between latching of the turbine system and commencement of initial loading, the regulating means 205 holds the valves 51' and 49' closed. A valve positioning means 206 is connected to position the bypass valve 53'. Upon latching of the turbine system the bypass valve 53' is opened by the valve positioning means 206, and is maintained open during acceleration of the turbine system to permit passaage of a small steam flow through the turbines 45' and 47' for purposes of heating the rotor portion of the intermediate pressure turbine 45' and cooling the blades near the exhaust end of the low pressure turbine 47'. As the auxiliary steam turbines 37' already is operating when the turbine system is latched, the steam pressure at the inlet of the reheat stop valve 51' is at an elevated level throughout the period of acceleration of the turbine system, due to the exhaust pressure of the steam turbine 37'. Thus the small steam flow through the turbines 45' and 47' is difficult to control accurately by means of the large intercept valve 49'. Inaccurate control of the steam flow through the turbines 45' and 47' may cause inaccurate control of the turbine shaft speed, or loss of shaft speed control. The bypass valve 53' is of such size that the small steam flow through the turbines 45' and 47' is controlled with accuracy that is satisfactory for turbine shaft speed control purposes, when the bypass valve 53' is opened to the elevated steam pressure at the inlet of the reheat stop valve 51'. The bypass valve 53' is maintained open by the positioning means 206 during the period of acceleration of the turbine system to synchronous speed, and during the time period between synchronization and commencement of initial loading. Upon commencement of initial loading the bypass valve 53' is closed.

A pressure reference source 207 generates an output signal representative of a desired steam pressure at the inlet of the throttle valve 23'. A pressure detecting means is connected to detect the steam pressure at the inlet of the throttle valve 23' and generates a signal representative of the detected pressure on a line 208. A comparison device 209 generates an output signal on a line 210 that represents the pressure error, or difference, between the desired and detected values of steam pressure at the inlet of the throttle valve 23', that is transmitted to a regulating means 211. The regulating means 211 positions the bypass valve 27' in accordance with the signal on the line 210 to vary the steam flow through the bypass line 25' to reduce the difference between the detected and desired steam pressures to a zero steady state value. The regulating means 211 positions the bypass valve 27' in accordance with a signal that is the sum of a first component that is proportional to the signal on the line 210 and a second component that is proportional to the time integral of the signal on the line 210.

A pressure reference source 212 generates an output signal that represents a desired value of steam pressure at the inlet of the reheat stop valve 51'. A pressure detecting means is connected to detect the steam pressure at the inlet of the reheat stop valve 51' and generates a signal on a line 213 that represents the detected pressure. A comparison device 214 generates a signal on an output line 215 that represents the difference, or error, between the desired and detected values of steam pressure at the inlet of the reheat stop valve 51'. The regulating means 216 positions the bypass valve 59' in accordance with the signal on the line 215 to vary the steam flow through the bypass line 57' to reduce to a steady state value of zero the pressure error that is represented by the signal on the line 215. The regulating means 216 positions the bypass valve 59' in accordance with a signal that comprises the sum of a first component that is proportional to the signal on the line 215 and a second component that is proportional to the time integral of the signal on the line 215.

The bypass line 25′ is connected to permit passage of a desired minimum steam flow through the steam generator 15′ when the steam flow through the turbine 21′ is less than such minimum. Similarly the bypass line 57′ is connected to permit passage of a desired minimum steam flow through the reheater 17′ when the steam flow through the turbines 45′ and 47′ is less than the desired minimum. Prior to latching of the turbine system, the pressure reference source 207 generates a signal representative of a desired steam pressure at the inlet of the throttle valve 23′ that corresponds to passage of the desired minimum steam flow through the steam generator 15′. The regulating means 211 positions the bypass valve 27′ to reduce to zero the pressure difference that is represented by the signal on the line 210, thereby causing the desired minimum steam flow to pass through the steam generator 15′ and the bypass line 25′. Prior to latching of the turbine system, the pressure reference source 212 generates a signal representative of a desired steam pressure at the inlet of the reheat stop valve 51′ that corresponds to passage of the desired minimum steam flow through the reheater 17′. The regulating means 216 positions the bypass valve 59′ to reduce to zero the pressure difference that is represented by the signal on the line 215, thereby causing the desired minimum steam flow to pass through the reheater 17′ and the bypass line 57′.

Upon latching of the turbine system, the regulating means 206 opens the bypass valve 53′ to pass a small steam flow through the turbines 45′ and 47′ for purposes of heating the rotor of the turbine 45′ and cooling the blades at the exhaust of the turbine 47′. To maintain the detected steam pressure represented by the signal on the line 213 at the reference value generated by the source 212 after the valve 53′ is opened, the regulating means 216 closes the bypass valve 59′ somewhat, to decrease the steam flow through the line 57′ by an amount that is effectively equal to the steam flow through the turbines 45′ and 47′. Thus the desired minimum steam flow through the reheater 17′ is maintained after latching of the turbine system.

As the desired speed signal from the input means 200 increases, the regulating means 204 positions the throttle valve 23′ or the control valve 19′, depending upon the shaft speed of the turbine system, to increase the steam flow through the turbine 21′, thereby causing the detected shaft speed to increase in accordance with the desired speed. As the steam flow through the turbine 21′ is increased for purposes of accelerating the turbine system, the regulating means 211 increasingly closes the valve 27′ to maintain the detected steam pressure represented by the signal on the line 208 at the reference value generated by the source 207. The steam flow through the bypass line 25′ thereby is decreased to compensate the increasing steam flow through the turbine 21′, and the desired minimum steam flow through the steam generator 15′ is maintained during acceleration of the turbine system.

Figure 3:
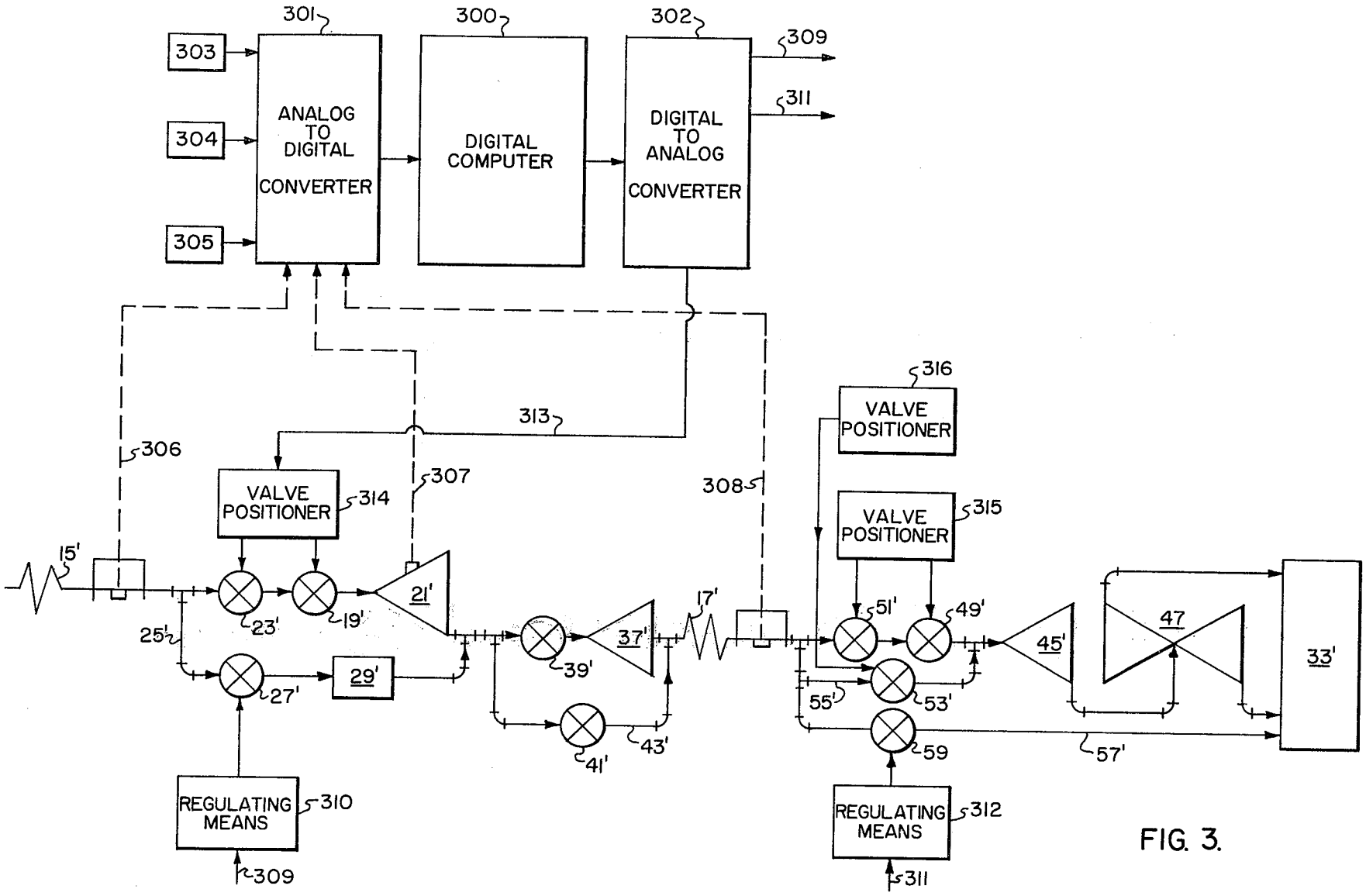
FIG. 3 illustrates an alternate implementation of the speed control system shown in FIG. 2.

Referring now to FIG. 3 there is shown an implementation of the speed control arrangement shown in FIG. 2 that uses a digital computer 300, an associated analog to digital (A/D) converter 301, and an associated digital to analog (D/A) converter 302. A reference source 303 generates a signal representative of a desired shaft speed of the turbine system comprising the turbines 21′, 45′ and 47′. Reference sources 304 and 305 generate signals representative of desired steam pressures at the outlet of the steam generator 15′ and at the outlet of the reheater 17′ respectively. A pressure detecting means is connected to detect the pressure of steam at the outlet of the steam generator 15′ and generates a signal representative of the detected pressure on line 306. A speed detecting means is connected to detect the shaft speed of the turbine system comprising the turbines 21′, 45′ and 47′ and generates a signal representative of the detected speed on line 307. The pressure detecting means is connected to detect the pressure of steam at the outlet of the reheater 17′ and generates a signal representative of the detected steam pressure on a line 308.

The output signals of the devices 303–305 and the signals on the lines 306–308 are connected to inputs of the A/D converter 301. Periodically, such input signals are scanned, and a digital representation of the analog value of each input signal is stored in memory of the digital computer 300. Periodically, the digital computer 300 uses the digital representations of the input signals to calculate digital pressure and shaft speed errors that are converted to analog values by the D/A converter 302. A digital representation of the pressure error, or difference, between the desired and deteced values of steam pressure at the outlet of the steam generator 15′ is calculated by the digital computer 300, and the analog value that corresponds to the pressure error is transmitted on a line 309 to a regulating means 310. Regulating means 310 positions the bypass valve 27′ in accordance with the sum of first signal that is proportional to the time integral of the input signal on the line 309 with a second signal that is proportional to such input signal. The digital computer 300 calculates a digital representation of the pressure error, or difference, between the desired and detected values of the steam pressure at the outlet of the reheater 17′; the analog value corresponding to such digital pressure error is transmitted to a valve positioner 312 on a line 311. The valve positioner 312 positions the bypass valve 59′ in accordance with a signal comprising the sum of a first component that is proportional to the time integral of the input signal on the line 311 with a second component that is proportional to such input signal. The digital computer 300 also calculates a digital representation of a difference, or error, between the desired and detected values of turbine shaft speed. The digital speed error is converted to a corresponding analog value by the D/A converter 302 that is transmitted to a valve positioner 314 on a line 313. When the shaft speed of the turbine system is less than a predetermined speed value, the valve positioner 314 positions the throttle valve 23′ in accordance with the signal on the line 313; the governor valve 19′ is held open at such times. When the shaft speed exceeds the predetermined speed value, the valve positioner 314 positions the governor valve 19′ in accordance with the signal on the line 313; the valve 23′ is held open at such times. During time intervals between successive calculations of the above-mentioned digital speed and pressure errors, the D/A converter 302 holds the signals on the lines 309–311 at levels that correspond to the most recently calculated digital input values. This is accomplished by using a D/A converter that is capable of holding its output signals at constant levels between conversions, or by utilizing a D/A converter that is capable of holding the values of its digital inputs between successive calculations of such inputs.

A valve positioner 315 holds the reheat stop valve 51′ and the interceptor valve 49′ closed during time periods when the turbine system is accelerated to synchronous speed, and after synchronization, prior to the commencement of loading. During such time periods, a valve positioner 316 holds the bypass valve 53' open to the elevated steam pressure at the outlet of the reheater 17' to control the heretofore described small steam flow through the turbines 45' and 47' that is required at such times.

To effect acceleration of the turbine system, the desired shaft speed signal from the reference source 303 is increased from turning gear speed to synchronous speed at a rate that does not subject to the turbine system to harmful thermal stress. As the desired shaft speed signal increases, the digital computer 300 periodically computes the difference, or end, between the desired and detected shaft speed values. The analog value that corresponds to such shaft speed error is transmitted to the valve positioner 314, which positions the throttle valve 23' or the governor valve 19' to vary the steam flow through the turbine 21' to reduce the analog value of the speed error. Thus, the steam flow through the turbine 21' is controlled to cause the shaft speed of the turbine system comprising the turbines 21', 45' and 47' to increase in accordance with the desired speed signal from the reference source 303.

As the steam flow through the turbine 21' is varied to control the turbine system shaft speed, the steam flow through the bypass line 25' is varied to maintain a desired minimum flow through the steam generator 15'. The reference source 304 generates a signal representative of a desired steam pressure at the outlet of the steam generator 15' that corresponds to the desired minimum flow through the steam generator. The digital computer 300 periodically calculates the pressure error between the desired and detected values of steam pressure at the outlet of the steam generator 15'. The analog value of such pressure error is transmitted on the line 309 to the regulating means 310, which positions the bypass valve 27' to vary the steam flow through the bypass line 25' to reduce the pressure error to a zero steady state value. Thus, a change of the steam flow through the turbine 21' is compensated by an equal, but opposite, change of the flow through the bypass line 25'. When no steam flows through the turbine 21', the bypass valve 27' is positioned to cause the detected steam pressure at the outlet of the steam generator 15' to equal the desired value of such pressure. The desired minimum flow of steam thereby passes through the steam generator 15' and the bypass line 25'. As the steam flow through the turbine 21' increases, the flow through the bypass line 25' is decreased by an equal amount, and the flow through the steam generator 15' is maintained at the desired minimum flow value.

During acceleration of the turbine system to synchronous speed, and after aynchronization, prior to commencement of loading, the bypass valve 53' is opened to permit a small steam flow through the turbines 45' and 47'. The steam flow through the bypass line 59' is varied to maintain a desired minimum flow through the reheater 17'. The reference source 305 generates a signal representative of the desired steam pressure at the outlet of the reheater 17' that corresponds to the dsired minimum flow through the reheater. The digital computer 300 periodically calculates the pressure error between the desired and detected values of steam pressure at the outlet of the reheater 17'. The analog value of such pressure error is transmitted on the line 311 to the regulating means 312, which positions the bypass valve 59' to vary the steam flow through the bypass line 57' to reduce the pressure error to a zero steady state value. Thus, a change of the steam flow through the turbines 45' and 47' is compensated by an equal, but opposite, change of the flow to the bypass line 57'. When no steam flows through the turbines 45' and 47', the bypass valve 59' is positioned to cause the detected steam pressure at the outlet of the reheater 17' to equal the desired value of such pressure, and the desired minimum flow passes through the reheater 17' and the bypass line 57'. When the bypass valve 53' is opened, the bypass valve 59' is closed somewhat to maintain the detected steam pressure at the outlet of the reheater 17' at the desired value of such pressure. The steam flow through the bypass line 57' is decreased by an amount equal to the flow through the turbines 45' and 47'. Thus, the desired minimum flow through the reheater 17' is maintained.

It should be understood that various modifications, changes and variations may be made in the arrangements, operations and details of construction of the elements disclosed herein without departing from the spirit and scope of the present invention.

I claim:

1. In a steam turbine system with first and second turbine stages and having first flow control valving in the flow path of the first turbine stage, a bypass line in parallel with the first flow control valving and the first turbine stage, first actuating means to adjust the first flow control valving, second flow control valving in the flow path of the second turbine stage, a bypass line in parallel with the second turbine stage and the second flow control valving, a second actuating means to adjust the second flow control valving, and an auxiliary steam turbine means connected in the flow path between the exhaust of the first turbine stage and the inlet of the second flow control valving, the exhaust pressure of said auxiliary steam turbine means causing an elevated steam pressure at the inlet of the second flow control valving at least during acceleration of the turbine system, an improved acceleration control arrangement for bringing the turbine system to operating speed comprising:

second flow control valving connected to govern a flow of steam through the second turbine stage, a start-up bypass valve connected across the second flow control valving; and third actuating means to open said bypass valve upon latching of the turbine system and to close said bypass valve upon initial loading of the turbine system, the second actuating means not opening the second flow control valving until initial loading of the turbine system is begun.

2. In a steam turbine system with a high pressure turbine and intermediate and low pressure turbines and having a throttle valve and a control valve in the flow path of the high pressure turbine, a first bypass line across the high pressure turbine and the throttle and control valves, first actuating means to adjust the throttle and control valves, a reheat stop valve and an interceptor valve in the flow path of the intermediate and low pressure turbines, a second bypass line across the intermediate and low pressure turbines and the reheat stop and interceptor valves, a second actuating means to adjust the reheat stop and interceptor valves, and an auxiliary steam turbine means connected in the flow path between the exhaust of the high pressure turbine and the inlet of the reheat stop valve, the exhaust pressure of the auxiliary steam turbine means causing an elevated steam pressure at the inlet of the reheat stop valve at least during acceleration of the turbine system, an improved acceleration control arrangement for bringing the shaft driven by the turbine system to synchronous speed comprising:

a reheat stop valve connected in the flow path of the intermediate and low pressure turbines to control the flow of steam through the intermediate and low pressure turbines, an interceptor valve connected between the outlet of the reheat stop valve and the inlet of the intermediate pressure turbine to control the flow of steam through the intermediate and low pressure turbines, a bypass valve connected to convey steam to the intermediate and low pressure turbines when opened; and third actuating means to open said bypass valve upon latching of the turbine system and to close said bypass valve upon initial loading of the turbine system, the second actuating means not opening both the reheat stop valve and the interceptor valve until initial loading of the turbine system is begun.

3. A speed control arrangement as claimed in claim 2 wherein:

said bypass valve is connected across the interceptor valve; and the second actuating means opens the reheat stop valve upon latching of the turbine system.

4. A system for controlling the acceleration of a turbine-generator in a power plant that includes a steam source to derive heat from the coolant gas of a high temperature nuclear reactor to generate superheated steam and reheated steam in respective first and second steam passage portions, said turbine including at least a high pressure turbine connected to pass superheated steam from the outlet of the first steam passage portion and a lower pressure turbine connected to pass reheated steam from the outlet of the second steam passage portion, a first bypass line connected to conduct steam from the outlet of the first steam passage portion to the exhaust of the high pressure turbine, a first bypass valve means connected to govern the steam flow through the first bypass line, a second bypass line connected to conduct steam from the outlet of the second steam passage portion to the exhaust of the lower pressure turbine, a second bypass valve means connected to govern the steam flow through the second bypass line, and an auxiliary steam turbine means rotatably coupled to drive a reactor coolant gas circulating means and connected to pass at least a portion of the steam flow from the exhaust of the high pressure turbine to the inlet of the second steam passage portion, the exhaust pressure of said auxiliary steam turbine causing an elevated steam pressure at the outlet of the second steam passage portion at least during acceleration of the turbine-generator, said control system comprising:

first valve means connected to govern a first steam flow from the outlet of the first steam passage portion to the inlet of the high pressure turbine, means connected to control a second steam flow from the outlet of the second steam passage portion to the inlet of the lower pressure turbine both when the flow rate is relatively low during acceleration of the turbine-generator, and during subequent operating times including load operation when the flow rate is higher, and means to position the first valve means to govern the first steam flow to accelerate the turbine-generator to synchronous speed.

5. A control system according to claim 4 wherein the means to control the second steam flow comprise:

second valve means connected between the outlet of the second steam passage portion and the inlet of the lower pressure turbine to control the second steam flow, and means to position the second valve means.

6. A control system according to claim 5 wherein the second valve means comprise:

main valve means connected between the outlet of the second steam passage portion and the inlet of the lower pressure turbine to control the second steam flow when the flow rate of the second steam flow is higher, and bypass valve means connected between the outlet of the second steam passage portion and the inlet of the lower pressure turbine to control the second steam flow when the flow rate of the second steam flow is relatively low.

7. A control system according to claim 6 wherein the bypass valve means is fully opened during acceleration of the turbine-generator.

8. A control system according to claim 5 wherein the second valve means comprise:

reheat stop valve means connected to the outlet of the second steam passage portion, interceptor valve means connected between the outlet of the reheat stop valve means and the inlet of the lower pressure turbine, the second steam flow being controlled by the reheat stop valve means and the interceptor valve means when the flow rate of the second steam flow is higher, and bypass valve means connected across the interceptor valve means to control the second steam flow at times when the flow rate of the second steam flow is relatively low, the reheat stop valve means being open and the interceptor valve means being closed at such times.

9. A control system according to claim 5 wherein the second valve means comprise:

reheat stop valve means connected to the outlet of the second steam passage portion, interceptor valve means connected between the outlet of the reheat stop valve means and the inlet of the lower pressure turbine, the second steam flow being controlled by the reheat stop valve means and the interceptor valve means when the flow rate of the second steam flow is higher, and bypass valve means connected across the reheat stop valve means to control the second steam flow at times when the flow rate of the second steam flow is relatively low, the reheat stop valve means being closed and the interceptor valve means being open at such times.

10. A control system according to claim 4 wherein the first valve means comprises:

throttle valve means connected to the outlet of the first steam passage portion, and control valve means connected between the outlet of the throttle valve means and the inlet of the high pressure turbine, the throttle valve means being positioned to control the first steam flow when the shaft speed of the turbine-generator is less than a predetermined value, and the control valve means being positioned to control the first steam flow when the shaft speed exceeds said predetermined value.

11. A control system according to claim 10 wherein the control valve means is fully opened at times when the throttle valve means is positioned to control the first steam flow, and the throttle valve means is fully opened at times when the control valve means is positioned to control the first steam flow.

12. A power plant that includes a steam source to derive heat from the coolant gas of a high temperature nuclear reactor to generate superheated steam and reheated steam in respective first and second steam passage portions, said coolant gas being circulated through said reactor and said steam source by a gas circulating means, said power plant comprising:

electric generating means, a steam turbine rotatably coupled to drive said electric generating means, said steam turbine at least including a high pressure turbine and a low pressure turbine, first valve means connected to govern a first flow of steam from the outlet of the first steam passage portion to the inlet of the high pressure turbine, a first bypass line connected between the outlet of the first steam passage portion and the exhaust of the high pressure turbine to permit passage of a desired steam flow through the first steam passage portion at times when the first steam flow is less than the desired steam flow, means to conduct steam from the exhaust of the high pressure turbine to the inlet of the second steam passage portion, said steam conducting means including an auxiliary steam turbine means connected to pass at least a portion of the steam flow from the high pressure turbine exhaust to the inlet of the second steam passage portion, and rotatably coupled to drive the reactor coolant gas circulating means, the exhaust pressure of the auxiliary steam turbine means causing an elevated pressure of steam at the outlet of the second steam passage portion at least during acceleration of the turbine-generator, means connected to control a second steam flow from the outlet of the second steam passage portion to the inlet of the lower pressure turbine both when the flow rate is relatively low during acceleration of the turbine-generator, and during subsequent operating times including load operation when the flow rate is higher, a second bypass line connected between the outlet of the second steam passage portion and the exhaust of the lower pressure turbine to permit passage of a desired steam flow through the second steam passage portion at times when the second steam flow is less than the desired steam flow, and means to position the first valve means to govern the first steam flow to accelerate the turbine-generator to synchronous speed.

13. A power plant according to claim 12 wherein the means to control the second steam flow comprise:

second valve means connected between the outlet of the second steam passage portion and the inlet of the lower pressure turbine to control the second steam flow, and means to position the second valve means.

14. A power plant according to claim 13 wherein the second valve means comprise:

main valve means connected between the outlet of the second steam passage portion and the inlet of the lower pressure turbine to control the second steam flow when the flow rate of the second steam flow is higher, and bypass valve means connected between the outlet of the second steam passage portion and the inlet of the lower pressure turbine to control the second steam flow when the flow rate of the second steam flow is relatively low.

15. A power plant according to claim 14 wherein the bypass valve means is fully opened during acceleration of the turbine-generator.

16. A power plant according to claim 13 wherein the second valve means comprise:

reheat stop valve means connected to the outlet of the second steam passage portion, interceptor valve means connected between the outlet of the reheat stop valve means and the inlet of the lower pressure turbine, the second steam flow being controlled by the reheat stop valve means and the interceptor valve means when the flow rate of the second steam flow is higher, and bypass valve means connected across the interceptor valve means to control the second steam flow at times when the flow rate of the second steam flow is relatively low, the reheat stop valve means being open and the interceptor valve means being closed at such times.

17. A power plant according to claim 13 wherein the second valve means comprise:

reheat stop valve means connected to the outlet of the second steam passage portion, interceptor valve means connected between the outlet of the reheat stop valve means and the inlet of the lower pressure turbine, the second steam flow being controlled by the reheat stop valve means and the interceptor valve means when the flow rate of the second steam flow is higher, and bypass valve means connected across the reheat stop valve means to control the second steam flow at times when the flow rate of the second steam flow is relatively low, the reheat stop valve means being closed and the interceptor valve means being open at such times.

18. A power plant according to claim 12 wherein the first valve means comprises:

throttle valve means connected to the outlet of the first steam passage portion, control valve means connected between the outlet of the throttle valve means and the inlet of the high pressure turbine, the throttle valve means being positioned to control the first steam flow when the shaft speed of the turbine-generator is less than a predetermined value, and the control valve being positioned to control the first steam flow when the shaft speed exceeds said predetermined value.

19. A power plant according to claim 18 wherein the control valve means is fully opened at times when the throttle valve means is positioned to control the first steam flow, and the throttle valve means is fully opened at times when the control valve means is positioned to control the first steam flow.

20. A system for controlling the shaft speed of a turbine-generator in a power plant that includes a steam source to derive heat from the coolant gas of a high temperature nuclear reactor to generate superheated steam and reheated steam in respective first and second steam passage portions, said turbine including at least a high pressure turbine and a lower pressure turbine, first valve means connected to govern a first steam flow from the outlet of the first steam passage portion to the inlet of the high pressure turbine, a first bypass line connected across the first valve means and the high pressure turbine, means connected to conduct a second steam flow from the outlet of the second steam passage portion to the inlet of the lower pressure turbine, a second bypass line connected between the outlet of the second steam passage portion and the exhaust of the lower pressure turbine, first and second bypass valve means connected to govern the steam flows through the respective first and second bypass lines, and auxiliary steam turbine means connected to use at least a portion of the steam flow from the exhaust of the high pressure turbine to the inlet of the second steam passage portion and rotatably coupled to drive a means for circulating the coolant gas through the reactor and the steam source, the exhaust pressure of the auxiliary steam turbine means causing an elevated steam pressure at the outlet of the second steam passage portion during acceleration of the turbine-generator, said control system comprising:

means to generate a first representation of a desired shaft speed of a turbine-generator, means connected to detect the shaft speed of the turbine-generator and to generate a second representation of the detected speed, means to position the first valve means in accordance with the difference between the first and second representations to vary the steam flow through the high pressure turbine to reduce the difference, means connected to control the second steam flow during acceleration of the turbine-generator when the second flow is relatively small, and during subsequent periods of operation, including post synchronization, when the second flow is larger, means responsive to a first power plant variable to position the first bypass valve means to compensate a change of the first steam flow by an equal, but opposite, change of the flow through the first bypass line, and means responsive to a second power plant variable to position the second bypass valve means to compensate a change of the second steam flow by an equal, but opposite, change of the flow through the second bypass line.

21. A control system according to claim 1 wherein the means to control the second steam flow comprise, main turbine valve means connected between the outlet of the second steam passage portion and the inlet of the lower pressure turbine to control the second steam flow when such flow is larger, and a bypass valve connected across the main turbine valve means to control the second steam flow when such flow is relatively small, the main turbine valve means being enclosed at such times.

22. A control system according to claim 1 wherein the means to control the second steam flow comprise:

reheat stop valve means connected to the outlet of the second steam passage portion, intercept valve means connected between the outlet of the reheat stop valve means and the inlet of the lower pressure turbine, the second steam flow being controlled by said reheat stop valve means and said interceptor valve means when such flow is larger, and bypass valve means connected across said intercept valve means to control the second steam flow when such flow is relatively small, said reheat stop valve means being open and said intercept valve means being closed at such times.

23. A control system according to claim 1 wherein the means to control the second steam flow comprise:

reheat stop valve means connected to the outlet of the second steam passage portion, intercept valve means connected between the outlet of the reheat stop valve means and the inlet of the lower pressure turbine, the second steam flow being controlled by said reheat stop valve means and said intercept valve means when such flow is larger, and bypass valve means connected across said reheat stop valve means to control the second steam flow when such flow is relatively small, said reheat stop valve means being closed and said intercept valve means being open at such times.

24. A control system according to claim 1 wherein the means to position the first bypass valve means comprise:

means to detect the steam pressure at the outlet of the first steam passage portion and generate a third representation of the detected pressure, means to generate a fourth representation of a desired steam pressure at the outlet of the first steam passage portion that corresponds to a desired minimum steam flow through the first steam passage portion, and means to position the first bypass valve means in accordance with a difference between the third and the fourth representations to reduce the difference, and the means to position the second bypass valve means comprise, means to detect the steam pressure at the outlet of the second steam passage portion and generate a fifth representation of the detected pressure, means to generate a sixth representation of a desired steam pressure at the outlet of the second steam passage portion that corresponds to desired minimum steam flow through the second steam passage portion, and means to position the second bypass valve means in accordance with a difference between the fifth and the sixth representations to reduce the difference.

25. A control system according to claim 1 wherein the first bypass valve means is positioned to cause a steam flow through the first bypass line that is equal to a desired minimum flow at times when the first valve means is closed and the steam pressure at the outlet of the first steam passage portion is equal to a first predetermined pressure value, and the second bypass valve means is positioned to cause a steam flow through the second bypass line that is equal to the desired minimum flow when the second steam flow is zero and the steam pressure at the outlet of the second steam passage portion is equal to a second predetermined pressure value.

26. A power plant that includes a steam source to derive heat from the coolant gas of a high temperature nuclear reactor to generate superheated steam and reheated steam in respective first and second steam passage portions, said coolant gas being circulated through said reactor and said steam source by a gas circulating means, said power plant comprising:

electric generating means, a steam turbine rotatably coupled to drive said electric generating means, said turbine including at least a high pressure turbine and a lower pressure turbine, first valve means connected to govern a first steam flow from the outlet of the first steam passage portion to the inlet of the high pressure turbine, a first bypass line connected across said first valve means and said high pressure turbine to permit a desired minimum flow through the first steam passage portion at times when the first flow is less than such minimum, first bypass valve means connected to govern the steam flow through said first bypaass line, auxiliary steam turbine means connected to pass at least a portion of the steam flow from the exhaust of said high pressure turbine to the inlet of the second steam passage portion, said auxiliary steam turbine means being rotatably coupled to drive the reactor coolant gas circulating means, means connected to control a second steam flow from the outlet of the second steam passage portion to the inlet of said lower pressure turbine both during acceleration of the turbine-generator when the second flow is relatively small, and during subsequent periods of operation, including post synchronization, when the second flow is larger, a second bypass line connected between the outlet of the second steam passage portion and the exhaust of said lower pressure turbine to permit a desired minimum flow through the second steam passage portion at times when the second flow is less than such minimum, second bypass valve means connected to govern the flow through said second bypass line, means to generate a first representation of a desired shaft speed of the turbine-generator, means connected to detect the shaft speed of the turbine-generator and generate a second representation of the detected speed, means to position said first valve means in accordance with a difference between the first and second representations to vary the steam flow through the high pressure turbine to reduce the difference, means responsive to a first power plant variable to position the first bypass valve means to compensate a change of the first steam flow by an equal, but opposite, change of the flow through the first bypass line, and means responsive to a second power plant variable to position the second bypass valve means to compensate a change of the second steam flow by an equal, but opposite, change of the flow through the second bypass line.

27. A power plant according to claim 7 wherein said means to control the second steam flow comprise:

main turbine valve means connected between the outlet of the second steam passage portion and the inlet of said lower pressure turbine to control the second steam flow when such flow is larger, and bypass valve means connected across the main turbine valve means to control the second steam flow when such flow is relatively small, the main turbine valve means being closed at such times.

28. A control system according to claim 7 wherein said means to control the second steam flow comprise:

reheat stop valve means connected to the outlet of the second steam passage portion, intercept valve means connected between the outlet of said reheat stop valve means and the inlet of said lower pressure turbine, the second steam flow being controlled by said reheat stop valve means and said intercept valve means when such flow is larger, and bypass valve means connected across said intercept valve means to control the second steam flow when such flow is relatively small, said reheat stop valve means being open and said intercept valve means being closed at such times.

29. A control system according to claim 7 wherein said means to control the second steam flow comprise:

reheat stop valve means connected to the outlet of the second steam passage portion, intercept valve means connected between the outlet of said reheat stop valve means and the inlet of said lower pressure turbine, the second steam flow being controlled by said reheat stop valve means and said intercept valve means when such flow is larger, and bypass valve means connected across said reheat stop valve means to control the second steam flow when such flow is relatively small, said reheat stop valve means being closed and said intercept valve means being open at such times.

30. A power plant according to claim 7 wherein said means to position the first bypass valve means comprise:

means to detect the steam pressure at the outlet of the first steam passage portion and generate a third representation of the detected pressure, means to generate a fourth representation of a desired steam pressure at the outlet of the first steam passage portion that corresponds to a desired minimum flow through the first steam passage portion, and means to position the first bypass valve means in accordance with a difference, between the third and the fourth representations to reduce the difference, and said means to position the second bypass valve means comprise:

means to detect the steam pressure at the outlet of the second steam passage portion and generate a fifth representation of the detected pressure, means to generate a sixth representation of a desired steam pressure at the outlet of the second steam passage portion that corresponds to a desired minimum steam flow through the second steam passage portion, and means to position the second bypass valve means in accordance with the difference between the fifth and the sixth representations to reduce the difference.

31. A power plant according to claim 7 wherein said first bypass valve means is positioned to cause a steam flow through said first bypass line that is equal to a desired minimum flow at times when said first valve means is closed and the steam pressure at the outlet of the first steam passage portion is equal to a first predetermined pressure value, and said second bypass valve means is positioned to cause a steam flow through said second bypass line that is equal to the desired minimum flow when the second steam flow is zero and the steam pressure at the outlet of the second steam passage portion is equal to a second predetermined pressure value.

* * * * *